United States Patent [19]

Kerekes

[11] 4,376,905

[45] Mar. 15, 1983

[54] ELECTRIC LAMP PROVIDED WITH A CERAMIC DISCHARGE TUBE

[75] Inventor: Béla Kerekes, Budapest, Hungary

[73] Assignee: Egyesült Izzolámpa és Villamossági Rt., Budapest, Hungary

[21] Appl. No.: 231,237

[22] Filed: Feb. 4, 1981

[30] Foreign Application Priority Data

Feb. 11, 1980 [HU] Hungary ..... 304/80

[51] Int. Cl.[3] ..... H01J 17/04; H01J 17/16; H01J 61/52

[52] U.S. Cl. ..... 313/217; 313/285

[58] Field of Search ..... 313/217

[56] References Cited

U.S. PATENT DOCUMENTS 3,992,642 11/1976 McVey et al. ..... 313/217 X 4,295,075 10/1981 Webb et al. ..... 313/217 X

*Primary Examiner*—Robert Segal

*Attorney, Agent, or Firm*—Gabriel P. Katona

[57] ABSTRACT

There is disclosed an electric lamp with a ceramic discharge tube and a current inlead consisting of two or more elementary filaments passing through a ceramic closing member and soldered thereto. In the tube there is an auxiliary electrode. The elementary filaments are preferably niobium. At least two of the elementary filaments are short circuited at both sides of the closing member and an auxiliary electrode is interlaced with the elementary filaments outside the discharge space.

8 Claims, 8 Drawing Figures

ELECTRIC LAMP PROVIDED WITH A CERAMIC DISCHARGE TUBE

BACKGROUND

The invention relates to an electric lamp provided with a ceramic discharge tube and a current inlead consisting of two or more elementary filaments, expediently wire, passing through the ceramic closing member. There is at least one elementary filament, expediently a wire, formed as an auxiliary electrode in the tube.

U.S. Pat. No. 3,243,635 discloses, electric lamps provided with a ceramic discharge tube which is closed on both ends by means of a metal disc serving simultaneously as a current inlead.

In another known electric discharge lamp, the tube is closed on both sides with a ceramic closing member, while the electrode is connected to the outer current lead via a separate current inlead. In the electric lamps with a ceramic discharge tube where the bulbs are closed by a ceramic closing member, soldering of the current inlead into the closing member is a problem due to the differences of the coefficients of thermal expansion.

U.S. Pat. No. 3,660,539 describes an electric discharge lamp wherein the current inlead is formed by a metal wire which is soldered into the bore of the closing member by using a vitreous solder. In order to be able to reduce the difference of the coefficients of thermal expansion, a current inlead made of niobium is used for the alumina- ceramic closing member.

The increased output of the electric discharge lamps, however, requires the delivery of a higher current quantity to the electrodes arranged inside at the two ends of the bulb. Accordingly, the cross-section of the current inlead has to be increased in proportion to the increased current quantity.

As a result of the increase of the cross-section of the current inlead, the heat conduction coming from the direction of the discharge space is also increased within the discharge tube. The "thermal shock" which, in the course of ignition, passes suddenly through the large cross-section current inlead causing a inconsiderable heat-drop with resultant damage and cracks in the ceramic closing member and at the glued, soldered surfaces of the ceramic closing member and metal current inlead. The foregoing phenomenon becomes more intensive as the current passing through the current inlead increases and the cross-section of the current inlead is increased.

The above phenomenon is well known and several methods were tried in efforts to avoid the detrimental stresses and the cracks resulting from it both at the glued or soldered surfaces of the metal current inlead and the ceramic closing member.

U.S. Pat. No. 3,363,134 discloses a method wherein compensation for the rise of the detrimental stresses is made by applying a thin-wall tube made of niobium; in this case an effort was made to reduce the detrimental dilatation effect resulting from the high temperatures arising upon ignition by utilizing the elasticity of the thin-wall tube.

U.S. Pat. No. 3,942,642 discloses a method wherein compensation is effected by lengthening the part of the current inlead connected to the electrode via the ceramic closing member, within the closing member with a helical form bent around the axis of the lamp, whereby the effect of the electrical shock can be delayed.

Both of the above structures have several drawbacks. One of the drawbacks of the device of U.S. Pat. No. 3,363,134 is that the tube-shaped current inlead only reduces the dilatation effect resulting from the thermal shock, but it is unable to eliminate it. Another drawback is that the application of the niobium tube increases production costs of the lamp to such an extent, that low costs cannot be ensured, as the price of the tube amounts to about hundredfold of the dense wire per unit of weight. Accordingly, this device is disadvantageous not only from the technical point of view of, but also of costs.

The drawback of the device of U.S. Pat. No. 3,992,664 is that the structural size of the helically bent current inlead within the lamp can be increased only within certain limits, since it is restricted by the inner size of the ceramic discharge tube of the lamp, and the mutual distance of the electrodes. As a consequence, the effect of the thermal shock cannot be entirely compensated. Simultaneously bending to the helical form and formation of the of the special lug needed for the connection to the electrode make the device difficult to produce.

The object of this invention is to provide an electric lamp with a ceramic discharge tube that does not have the drawbacks enumerated above. A further object of this invention is to provide such a lamp that can stop the detrimental dilatation effect resulting from thermal shocks, even with an enlarged cross-section of the current inlead, which is the structure of the high-output lamps and which is easily and economical to produce, yet is safe to operate.

BRIEF DESCRIPTION OF THE INVENTION

The invention is based on the discovery, that the detrimental dilatation effects, as e.g. cracking of the soldering and the ceramic closing member, resulting from the thermal shock due to the increased cross-section of the metal current inlead which is soldered in a vacuum-tight manner into the closing member and passes through the same—representing an essential condition when increasing the output of the lamp—can be avoided only by using a current inlead with a divided cross-section consisting of at least two or more elementary filaments, expediently niobium wires which are separately soldered into the ceramic closing member.

The current inlead according to the invention is formed in such a manner, that at least two out of the elementary filaments, expediently niobium wires, which are soldered into the closing member and passing through the same individually, are short-circuited electrically and heat-technically at both sides of the closing member and a further elementary filament, advantageously a niobium wire is formed as an auxiliary electrode and the elementary filaments, expediently niobium wires, are interlaced outside the discharge space.

BRIEF DESCRIPTION OF THE DRAWINGS

The invention is described in the accompanying drawings, wherein.

DETAILED DESCRIPTION

Figure 1:
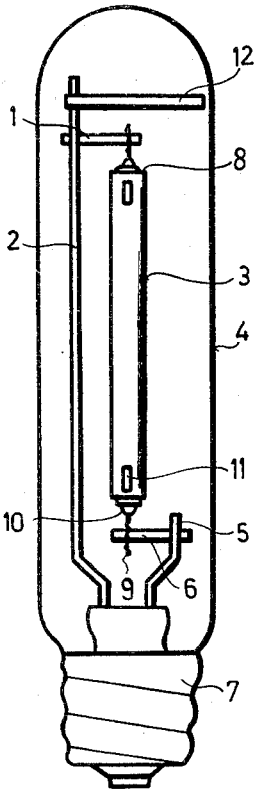
FIG. 1 is an elevational view showing the electrical discharge lamp provided with a ceramic tube, with the complete armature contained in a bulb and provided with a lamp base.
Figure 2:
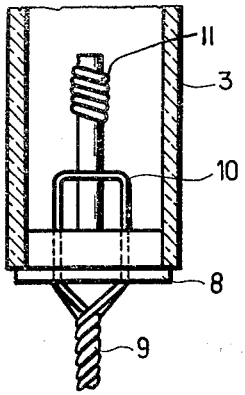
FIG. 2 shows two sectional side-views and a top-view, at which the current inlead consisting of four elementary filaments, expediently niobium wires, establishes the connection between the electrode arranged in the discharge space and the outer current lead via the ceramic closing member.
Figure 2A:
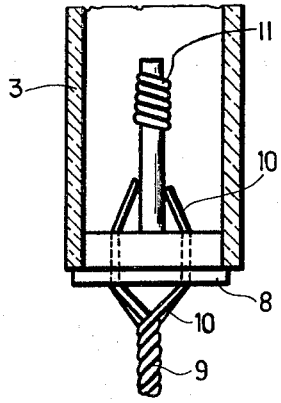
FIG. 2*a* shows another embodiment of the lamp of FIG. 2.
Figure 2B:
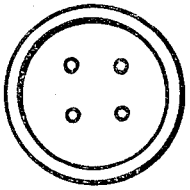
FIG. 2*b* shows a ceramic closing plate such as is employed in the lamp of the embodiments of FIGS. 2 and 2*a*.
Figure 4:
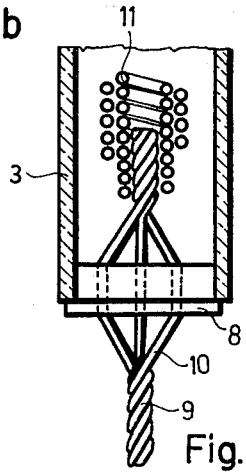
FIG. 4 shows the section and top-view of an embodiment at which the elementary filaments, expediently niobium wires, of the current inlead consisting of three elementary filaments, expediently niobium wires, passing through the ceramic closing member are interlaced in the discharge space and outside the discharge space.
Figure 4A:
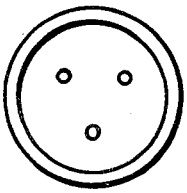
FIG. 4*a* shows a ceramic closing plate such as is employed in the lamp of the embodiment of FIG. 4.
Figure 3:
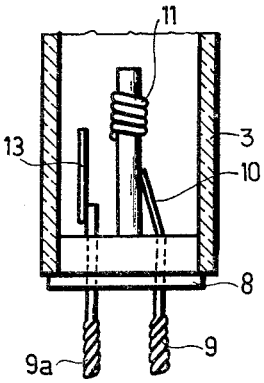
FIG. 3 shows in two sectional side-views, at which the current inlead consisting of four filaments, expediently niobium wires, is formed in such a manner, that two elementary filaments out of the four are connecting the external current lead to the electrode in the discharge space, while the other two elementary filaments establish the connection between the outer current lead and the auxiliary electrode lying also in the discharge space.
Figure 3A:
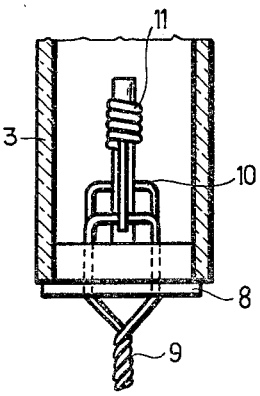
FIG. 3*a* shows another embodiment of the lamp of FIG. 3.

As shown in FIG. 1, an electric discharge lamp—is provided with a ceramic discharge tube 3 enclosed in a glass-bulb 4 containing vacuum or filled with an inert gas and with a lamp base 7. A current inlead 9 consisting of two or more elementary filaments 10, expediently niobium wires is soldered into a ceramic closing member 8 as and having been as shown in FIGS. 2, 3 and 4 is connected to an electrode 11 arranged in the discharge space and interlaced at the outer end. The current inlead 9 is electrically connected at one end of the tube 3 via a support 5 and an outer current lead 6 and at the other end of the tube 3 via a second support 2 and a second outer current lead 1 with the lamp base 7.

The position of the electric discharge lamp with the ceramic discharge tube 3 in the glass bulb 4 is ensured by means of the supports 2, 5 and a support ring 12 at the upper part of the glass bulb 4.

As shown in FIG. 2, one end of the electric discharge lamp with the ceramic discharge tube 3 has a current inlead 9 consisting of four elementary filaments 10, expediently niobium wires, passing through the ceramic closing member 8 closing the ceramic discharge tube 3 of the four elementary filaments, expediently niobium wires, connected to the electrode 11 and arranged in the discharge space, two filaments each are electrically and heat short-circuited and bent to a U-shape, simultaneously outside the discharge space four elementary filaments, expediently niobium wires, are interlaced and form a rigid structure complying with the requirements regarding strength.

The device shown in FIG. 2 is prepared, as described below:

Four bores are on the closing member 8 and two elementary filaments 10, preferably niobium wires having been bent previously to a U-shape are soldered in a vacuum-tight manner into the bores by using a ceramic or a vitreous solder. Thereafter the U-shaped niobium wire is welded to the electrode 11. The four free ends of the elementary filaments 10, expediently niobium wires, are interlaced on the opposite side of the ceramic closing member 8. Then the current inlead 9 consisting of the elementary filaments 10, expediently niobium wires, is electrically and heat short-circuited on both sides of the ceramic closing member 8. The ceramic closing member prepared as described above, is soldered in a vacuum-tight manner to the end of the ceramic discharge tube 3. In the high-pressure sodium-vapour-lamp 200 V/400 W, made as described above, the inner diameter of the ceramic tube 3 is about 8 mm, the diameter of the niobium wire is about 0.5 mm and the diameter of the tungsten electrode is about 1.2 mm.

In the embodiment shown in FIG. 3, four elementary filaments 10, expediently niobium wires, are passed through the ceramic which closes member 8 closing the ceramic discharge tube 3, from which two elementary filaments 10, each preferably a niobium wire, are short-circuited within the discharge space and bent to a U-shape in such a manner, that one of the elementary filaments 10, preferably a niobium wire, bent to a U-shape is connected to the electrode 11. The other elementary filament, also bent to a U-shape and being preferably a niobium wire, is connected electrically to an auxiliary electrode 13. Simultaneously two elementary filaments 10, each preferably a niobium wire, are separately interlaced outside the discharge space forming the current inleads 9*a* and 9, respectively.

In the embodiment shown in FIG. 4, the current inlead 9 is formed by three elementary filaments 10, preferably niobium wires, passing through the ceramic closing member 8 which closes the ceramic discharge tube 3 in such a manner that the ends of the three elementary filaments 10 are connected to the electrode 11 and the ends of the elementary filaments 10, preferably niobium wires, which lying outside the discharge space, are interlaced.

It is not intended to restrict the invention to the embodiments described here, since it is intended to include all the variational possibilities of forming current inleads which consist of two or more elementary filaments, preferably niobium wires, passing through the ceramic closing member, since the number and size of the elementary filaments change, depending on the output of the electric lamp provided with a ceramic discharge tube.

Experiments have shown, that when using niobium wires it is not advisable to increase the cross-section of the elementary filaments about 0.28 $mm^2$, since when soldering a wire with a dense cross-section surpassing the above mentioned value into the ceramic closing member, the arising thermal shocks are greater and will cause cracks. Accordingly, the current inlead according to the invention may be formed, depending on the output of the lamp, of two, three, four, or more elementary filaments in any desired optional arrangements which occur to the skilled artisan.

The specific arrangement of the elementary filaments forming the current inlead in the ceramic closing member is not critical to the invention. The essence of the invention that the elementary filaments are be soldered separately and individually into the ceramic closing member without regard to their specific arrangement. In order to be able to concentrate and support the electrodes and to facilitate welding it is advantageous to apply elementary filaments in even numbers, preferably two or four, whereas if we intend to use one or more of the elementary filaments as auxiliary electrodes, filaments in uneven numbers are more advantageous. In the latter case, in accordance with the invention, beside the current inlead of the auxiliary electrode the current inlead of the main electrode is formed, as described in the present specification, from at least two or more elementary filaments. The cross-section and the profile of the elementary filaments forming the current inlead are not critical to the invention. The elementary filament arranged within the discharge space and connected to the electrode yields an electrically and heat short-circuited structure not only when bent to a U-shape, but in any other optional form, e.g. when the separate straight elementary filaments are welded in a transversal direction to a preferably straight plate.

What we claim:

1. An electric lamp with a ceramic discharge tube having a discharge tube made of a ceramic material or a crystalline structure, an electrode within the tube, a current inlead connecting the electrode to an outer current lead and ceramic closing members closing the ends of the tube, at least one of which is made of a ceramic material, wherein the electrical connection between the outer current lead and the electrode is established by means of a current inlead consisting of two or more elementary filaments passing through the ceramic closing member and separately soldered in a vacuum tight manner into the ceramic closing member, at least one elementary filament connected electrically to the current feeder and passing through the ceramic closing member is formed as an auxiliary electrode and/or as a current inlead of the auxiliary electrode.

2. The electric lamp of claim 1, wherein at least two of the elementary filaments of the current inlead are short-circuited on both sides of the ceramic closing member.

3. The electric lamp of claim 1, wherein the elementary elementary filament wires of the current inlead and the auxiliary electrode are interlaced outside the discharge space.

4. The electric lamp of claim 1, wherein the elementary filament wires of the current inlead are interlaced outside the discharge space.

5. The electric lamp of claim 1, wherein at least two elementary filament wires of the current inlead and the elementary filament of the auxiliary electrode wire are soldered into the ceramic closing member in a vucuum tight manner.

6. The electric lamp of claim 1, wherein at least two elementary filament wires of the current inlead are bent to a U-shape within the discharge space.

7. The electric lamp of claim 1, wherein the cross-sections of the elementary filament wires of the current inlead and the auxiliary electrode are maximally about 0.3 $mm^2$.

8. The electric lamp of claim 1, wherein the elementary filament wires are niobium metal.

* * * * *